US011156441B2

(12) United States Patent
Wagner et al.

(10) Patent No.: US 11,156,441 B2
(45) Date of Patent: Oct. 26, 2021

(54) PROJECTILE, METHOD OF MANUFACTURING A PROJECTILE AND AMMUNITION

(71) Applicant: RUAG Ammotec GmbH, Fuerth (DE)

(72) Inventors: Thomas Wagner, Pinzberg (DE); Gerhard Mehl, Fuerth (DE)

(73) Assignee: RUAG AMMOTEC GMBH, Fuerth (DE)

( * ) Notice: Subject to any disclaimer, the term of this patent is extended or adjusted under 35 U.S.C. 154(b) by 0 days.

(21) Appl. No.: 16/900,503

(22) Filed: Jun. 12, 2020

(65) Prior Publication Data

US 2020/0393224 A1 Dec. 17, 2020

(30) Foreign Application Priority Data

Jun. 14, 2019 (DE) ..... 10 2019 116 283.1

(51) Int. Cl.
*F42B 10/46* (2006.01)
*F42B 10/44* (2006.01)

(52) U.S. Cl.
CPC ..... *F42B 10/46* (2013.01); *F42B 10/44* (2013.01)

(58) Field of Classification Search
CPC ..... F42B 10/46; F42B 10/44
USPC ..... 102/439
See application file for complete search history.

(56) References Cited

U.S. PATENT DOCUMENTS 4,327,643 A 5/1982 Fernando
4,958,570 A * 9/1990 Harris ..... F42B 14/02 102/439
6,657,174 B1 * 12/2003 Olsson ..... F42B 10/44 102/501
8,485,100 B2 * 7/2013 Lee ..... F42B 14/064 102/430
8,973,504 B2 * 3/2015 Kim ..... F42B 10/44 102/501
10,139,207 B2 * 11/2018 Adams ..... F42B 10/38
2005/0268807 A1 * 12/2005 Bambach ..... F42B 5/035 102/438

(Continued)

FOREIGN PATENT DOCUMENTS

DE 40875 C 3/1887
DE 298055 C 3/1915

(Continued)

OTHER PUBLICATIONS

Office Action for German Application 10 2019 116 283.1 dated Apr. 3, 2020.

(Continued)

*Primary Examiner* — Samir Abdosh

(74) *Attorney, Agent, or Firm* — Fitch, Even, Tabin & Flannery LLP

(57) ABSTRACT

The present invention relates to a projectile for ammunition, in particular rimfire ammunition, comprising a preferably ogive-shaped nose section and a projectile tail which has an annular recess at an end face, an annular edge circumferentially surrounding the annular recess and radially outwardly delimiting the recess in the circumferential direction, and a projection arranged in the annular recess and extending in the longitudinal direction of the projectile, wherein the annular edge, the projection and optionally the nose section are manufactured in one piece.

17 Claims, 3 Drawing Sheets

(56) References Cited

U.S. PATENT DOCUMENTS

Figure 1:
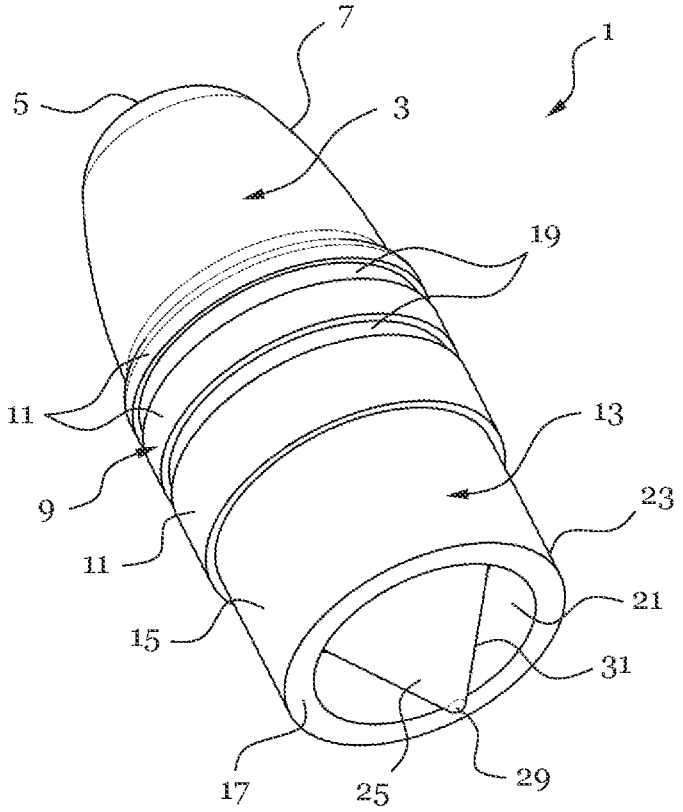

| | | | | |
|---|---|---|---|---|
| 2011/0030571 | A1* | 2/2011 | Lee | F42B 14/064 102/430 |
| 2015/0337878 | A1 | 11/2015 | Schlosser | |
| 2018/0120069 | A1* | 5/2018 | Kim | F42B 10/46 |
| 2020/0393224 | A1* | 12/2020 | Wagner | F42B 10/46 |

FOREIGN PATENT DOCUMENTS

| | | | |
|---|---|---|---|
| DE | 4038777 | A1 | 6/1992 |
| DE | 10 2017 126 442 | A1 | 5/2019 |
| EP | 0106411 | A2 | 4/1984 |
| FR | 496520 | A | 11/1919 |
| KR | 20 2011 0067 880 | A | 6/2011 |
| WO | 2019/231043 | A1 | 12/2019 |

OTHER PUBLICATIONS

Extended European Search Report dated Oct. 16, 2020 in counterpart EP Appln. 20179803.0.

* cited by examiner

PROJECTILE, METHOD OF MANUFACTURING A PROJECTILE AND AMMUNITION

CROSS-REFERENCE TO RELATED APPLICATION

Reference is made to German Patent Application No. 10 2019 116 283.1 filed Jun. 14, 2019, to which priority is claimed and which is incorporated herein by reference in its entirety.

The present invention relates to a projectile for ammunition, in particular for rimfire ammunition. Furthermore, the present invention relates to a process for manufacturing a projectile for ammunition, in particular for rimfire ammunition. Further, the present invention provides ammunition, in particular rimfire ammunition.

The design of projectiles is usually based on two main objectives which are usually in conflict with each other. On the one hand, the aim can be to maximize the acceleration of the projectile in the barrel of a firearm. On the other hand, the focus can be on optimising the aerodynamics of the projectile in order to achieve, on the one hand, the best possible precision and, on the other, the longest possible firing range.

U.S. Pat. No. 8,485,100 B2 discloses an aerodynamically improved drop-shaped projectile, the tail of which is inserted into a separate holding sleeve, which is pressed into a cartridge sleeve. The retaining sleeve acts as a so-called sabot and serves to seal the gun barrel and to absorb the gas pressure. After the bullet is fired, it separates from the holding case. With U.S. Pat. No. 8,485,100 B2 the precision of the bullet has proven to be disadvantageous. In particular, there is neither a spin stabilization in the barrel of the firearm, nor a stabilization during the flight, so that according to U.S. Pat. No. 8,485,100 B2 the bullet is susceptible to external influences, such as wind, which cause it to deviate from the desired flight path.

U.S. Pat. No. 10,139,207 B2 discloses a projectile with a rear recess into which a plurality of separate tail attachments concentrically arranged to each other are screwed in order to achieve an improved grass pressure effect to increase acceleration. The tail attachments also have a rear recess into which a tail attachment is screwed. The tail attachments are shaped and dimensioned in relation to the recesses in such a way that a circumferential annular space is created, the cross-section of which is increasingly reduced in the opposite direction to the direction of firing. Such a projectile, however, has a disadvantageous aerodynamics, so that on the one hand a short flight range and on the other hand a low precision is achieved.

It is an object of the present invention to improve the disadvantages of the known state of the art, in particular to provide a projectile whose precision is improved, especially without impairing the acceleration within the barrel of the firearm.

The object is solved by the features of claims 1, 10 and ii, respectively.

According to an aspect of the present invention a projectile for ammunition, in particular for rimfire ammunition, is provided. Ammunition or cartridges comprise the components necessary for firing the projectile or bullet from a firearm and usually consist of a sleeve, a percussion cap, a propellant and a projectile. The rimfire ammunition is a special type of ammunition. The ignition means or firing charge of rimfire ammunition is arranged in the ground of the sleeve in the area of a circumferential annular ridge respectively is casted into the same. Upon impact of a correspondingly shaped firing pin from the back onto the annular ridge of the sleeve bottom the annular ridge is squeezed in order to cause ignition of the firing charge arranged in the annular ridge and subsequently of the propellant powder being in contact with it. The projectile, also called bullet, is the component which is fired by the firearm. For example, the projectiles according to the invention have a caliber of at most 13 mm, in particular of at most 12.7 mm. The caliber is essentially a measure of the outer diameter of projectiles and/or the inner diameter of the barrel of a firearm.

The projectile comprises a nose section which is arranged on a front side in the longitudinal direction of the projectile respectively with regard to the direction of flight and which may be ogive-shaped, in particular in order to have a flow-optimized shape. Further, the projectile comprises a projectile tail which is arranged on a rear side with regard to the direction of flight and in relation to the longitudinal direction of the projectile.

The projectile tail comprises at an end face, which is preferably oriented opposite to the direction of flight, an annular recess. The annular recess extends for example from the end face in the direction of the nose section for a certain axial length. The annular recess is radially outwardly in the circumferential direction delimited by a circumferential annular edge, which is part of the projectile tail. In the annular recess a projection extending in the longitudinal direction of the projectile is arranged. The projection is at least in sections radially spaced from the annular edge such that in particular the annular recess results.

According to an aspect of the invention, the annular edge and the protrusion and optionally the nose section are manufactured in one piece. In particular, the projectile is completely manufactured in one piece, preferably from metal. Thereby, it is possible to manufacture a projectile with improved precision in a simple and cost-effective manner which also has a good acceleration within the barrel of the firearm. The tail section, in particular the annular edge, is designed so flexible or deformation soft such that its shape can slightly change upon firing the bullet due to the rear-side gas pressure. Thereby, a constant acceleration within the barrel without disturbances due to friction, in particular at stiff edges, for example when entering the barrel as well as when leaving the barrel, is achieved. Further, the projection arranged in the annular recess together with the annular edge circumferentially surrounding the annular recess achieves an undercut or an indentation into which the powder gas formation may apply a force which is increased with regard to standard tails such that also an improvement of the barrel acceleration is achieved. Further, it has been found out according to the invention that the arrangement of a projection extending in the longitudinal direction of the projectile in the annular recess causes a stabilization of the projectile during flight. This is due in particular to the fact that tail turbulences may develop around the pin which may extend into the annular recess and therefore into the interior of the projectile due to the indentation in order to stabilize the bullet during flight. Further, consequently the so-called base drag, a tail-side suction effect, is reduced. The projectile according to the invention is therefore characterized by an improved precision as well as an improved barrel performance, such as an increased acceleration and/or reduced friction during the barrel.

According to an example embodiment of the present invention the annular edge comprises an essentially constant wall thickness along its longitudinal extension in the longitudinal direction of the projectile of 5% to preferably 30% of a caliber diameter. The caliber is generally a measure for the outer diameter of projectiles respectively for the inner diameter of the barrel of the firearm. Preferably, the wall thickness equals approximately 8% to preferably 20% of the caliber diameter. According to an exemplary embodiment of the projectile according to the invention an axial dimension of the annular edge lies in the range of 5% to preferably 30% of a total length of the projectile. Furthermore, the annular edge may be arranged concentrically with regard to the projectile length axis oriented in the longitudinal direction of the projectile. Further, the annular edge may comprise a constant outer diameter and/or an outer shell surface of the annular edge may comprise a constant distance with regard to the projectile length axis. In particular, the specific dimensioning of the annular edge assures that the annular edge may ease into the free space in the annular recess realized by undercut or indentation which becomes noticeable upon entering of the projectile into the barrel, upon pressing into the rifling of the barrel and when leaving the barrel. Thereby, aligning, in particular centering, of the projectile within the barrel is supported and optional disturbances or changes in direction, for example due to tilting, are reduced. Further, it has been found out that stable tail turbulences behind the projectile are formed along the projection into the annular recess, in particular to a ground of the recess, during flight of the projectile, which leads to an extension of flow guidance closer to the projectile length axis. Thus, the so-called tail pressure difference at the projectile tail is reduced and consequently the so-called base drag. Further, the projectile tail shape according to the invention has an advantageous effect on the precision in that the projection in combination with the annular recess and the annular edge surrounding the annular recess causes a stabilization of the tail turbulences so that the projectile is less susceptible to external force influences, such as wind influences.

According to an example further development of the projectile according to the invention the projection comprises an at least in sections a continuous cross-section, in particular in the longitudinal direction of the projectile, and/or a cross-section tapering in the opposite direction with regard to the flight direction. For example, the projection is cone-shaped, frustum-shaped or curved, preferably partly spherical, in particular semispherical. For example, the projection is arranged concentrically with regard to the projectile length axis oriented in the longitudinal direction of the projectile. Consequently, the effect of stabilizing the projectile according to the invention during its flight is improved. Thus, a rotationally symmetric shape of the projectile tail, in particular of the annular edge, the annular recess and the projection may be elaborated with regard to the projectile length axis. It has been found out that the cross-section of the projection tapering in the direction of the projectile tail or being curved, preferably round, is advantageous for the formation of tail turbulences during flight of the projectile, namely preferably an increasingly elliptical shape of the tail turbulences (according to simulation) is generated and/or the turbulences extend into the interior of the projectile, namely into the annular recess.

According to an exemplary further embodiment of the present invention the annular recess surrounds the projection in the circumferential direction radially outwardly, in particular completely. Further, the projection may in particular circumferentially directly merge into the annular edge. The annular recess may therefore have an essentially triangular cross-section.

In a further example embodiment of the projectile according to the invention the annular recess, starting from a transition contour, such as a transition edge or a transition bar extending across, preferably perpendicular, with regard to the longitudinal direction of the projectile, between the projection and the annular recess at least in sections continuously expands. Furthermore, a cross-section of the annular recess, starting from the transition contour, between the projection and the annular edge may at least in sections continuously increase. For example, the projection directly merges into the annular edge such that a sharp transition edge is formed as the transition contour. Further, a transition contour in the form of a transition bar between the annular edge and the projection extending across the longitudinal direction of the projectile and preferably surrounding the projection in the circumferential direction may be formed whereby a volume defined by the annular recess is increased.

According to an exemplary further development of projectile according to the invention, the projection comprises an axial length in the longitudinal direction of the projectile in the range of 20% to 140% of a caliber diameter. Thereby, the minimum length of the projection may generate an ideal space or place for the formation or development of tail turbulences. The maximum length of the projection may for example cause the ideal development of the flowlines during the flight of the projectile such that flow lines as long as possible, i.e. extending as far away as possible away from the projectile tail in the direction of the projectile length axis are caused. According to an example further development the projection may axially protrude the end face of the projectile tail in the longitudinal direction of the projectile. For example, the projection protrudes at least 5% of a caliber diameter and/or at most 50% of a caliber across the end face of the projectile tail. It has been found out that for minor lengths of the projections the center of mass of the projectile is slightly moved to the front in the direction of the pressure point, i.e. the point during the flight of the projectile where the sum of affecting forces is null. Further, it has been found out that starting at a certain axial length of the projectile, in particular from a certain axial protrusion with regard to the end face of the projectile tail, the center of mass is moved absolutely slightly to the back, relative to the change of length however also to the front in the direction of the projectile nose and in the direction of the pressure point. According to the invention, the arrangement of the projection within the annular recess in particular due to the preferred dimensioning according to the invention achieves that a stabilization of the projectile during its flight may be assured whereby its precision is significantly improved.

In another exemplary embodiment of the present invention, the projection has a conical shape or a truncated cone shape. The cone shape or truncated cone shape can be oriented in the direction of the tail of the projectile, i.e. against the flight direction of the projectile in the longitudinal direction of the projectile. In other words, a cone tip or a truncated cone end points in the opposite direction of the direction of flight of the projectile. Furthermore, an angle of aperture or opening angle of a shell of the projection starting from a cone tip or a truncated cone end can be at least 20° and preferably at most 90°, in particular 60°. It has been found that this dimensioning of the projection results in a volume of the annular depression, so that the advantages of the invention are increased.

According to an exemplary further embodiment of the projectile according to the invention the projection in the interior of the projectile merges into an annular recess ground which may be realized by the transition contour. The recess ground may be oriented in the radial direction and merge into the annular edge. For example, the recess ground may be formed as a circumferential transition or a circumferential transition bar with a radial extension. For example, a radial ring dimension of the recess ground, in particular of the transition bar, may be at least 0.05 mm and preferably at most 1.5 mm. It should be clear that in case of a transition edge as the transition contour respectively recess ground no significant ring dimension is present, rather the edge directly merges into the protrusion.

In an exemplary embodiment of the projectile according to the invention the projectile is manufactured by forming, in particular tensile-compressive forming, preferably deep drawing. The blank may be for example a metal band/or a metal wire which firstly is formed such that a particularly ogive-shaped nose section and a flat projectile tail is realized, for example by pressing. Afterwards, an annular recess and a projection extending in the longitudinal direction of the projectile are introduced, preferably pressed, into the projectile tail, for example by means of a die pressed onto the tail.

According to a further aspect of the present invention which may be combined with the previous aspects and exemplary embodiments, a method for manufacturing a projectile for ammunition, in particular rimfire ammunition, is provided. The method according to the invention can be configured such that it may realize, in particular manufactures, the projectile according to one of the previous aspects or previous embodiments.

The method according to the invention includes providing a metal band blank or a metal wire blank. The metal band blank or metal wire blank may for example be preassembled, i.e. pre-aligned with regard to a required axial length and/or wall thickness dimension. It is also possible that the entire shaping is achieved via the subsequent manufacturing process which may be a forming process, a tensile-compressive forming process, in particular a deep drawing process.

In a subsequent manufacturing step the metal band blank or metal wire blank is formed, preferably pressed, for the formation of a preferably ogive-shaped nose section and a projectile tail, preferably having a flat end face. The projectile tail may have a cylindrical shape, when considering the outer circumference, and merge into a flat, particularly extending perpendicular with regard to the longitudinal direction of the projectile, end face.

In a further subsequent step, an annular recess and a projection extending in the longitudinal direction of the projectile are introduced, preferably pressed, into the projectile tail. The projection and the annular recess are introduced, in particular pressed, into the projectile tail in such a way that a circumferential annular edge surrounding the annular recess is formed which delimits the annular recess radially outwardly and/or the annular recess circumferentially surrounds the projection radially outwardly.

This makes it possible to produce a projectile with improved precision in a simple and cost-effective manner, which also has a good acceleration within the barrel of the firearm. The tail section, in particular the annular edge, can be formed so flexible or soft that its shape can slightly change when the projectile is fired as a result of the rear gas pressure. In this way, a constant barrel acceleration is achieved without disturbances due to friction, especially at stiff edges, for example when the bullet enters the barrel as well as when it leaves the barrel. In addition, the projection in the annular recess, together with the annular edge surrounding the annular recess in a radial direction, creates an undercut or indentation on which the powder gas development can exert a force that is greater than on a conventional tail, so that the barrel acceleration is also improved. In addition, it was found out according to invention that a stabilization of the projectile in flight is achieved by producing a projection in the annular recess extending in the longitudinal direction of the projectile. This is particularly related to the fact that tail turbulences can form around the pin, which can extend through the undercut into the annular recess and thus into the interior of the projectile in order to stabilize the projectile during its flight path. Furthermore, the so-called "base drag", a tail-side suction effect, is reduced in this way. The projectile manufactured in accordance with the invention is thus characterized by both improved precision and improved barrel performance, such as increased acceleration and/or reduced friction within the barrel.

According to another aspect of the present invention, which can be combined with the preceding aspects and exemplary embodiments, ammunition, in particular rimfire ammunition, is provided. The ammunition comprises an ammunition sleeve and a projectile preferably pressed into the ammunition sleeve. The projectile may be realized according to one of the aspects or exemplary embodiments described above and/or manufactured by the inventive method for manufacturing a projectile described above.

According to an exemplary execution of the present invention, the nose section protrudes from the ammunition sleeve in the longitudinal direction of the projectile. Furthermore, a guide band connecting the nose section with the projectile tail and/or the projectile tail may be pressed with an inner jacket of the ammunition case. It may be provided that the guide band is divided into guide band sections arranged at a distance from one another in the axial direction, preferably of different axial dimensions and/or the same radial dimension.

Preferred embodiments are given by the dependent claims.

Figure 2:
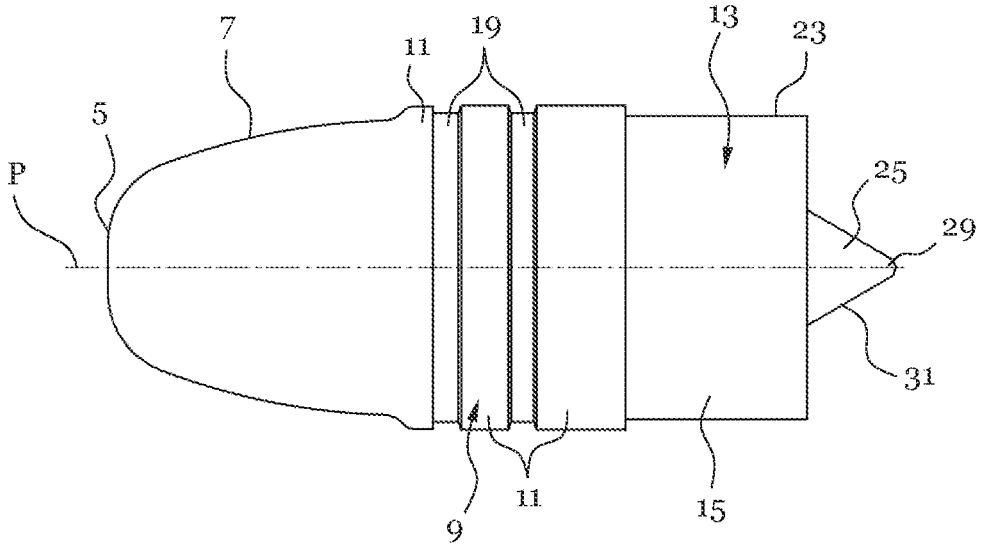
Figure 3:
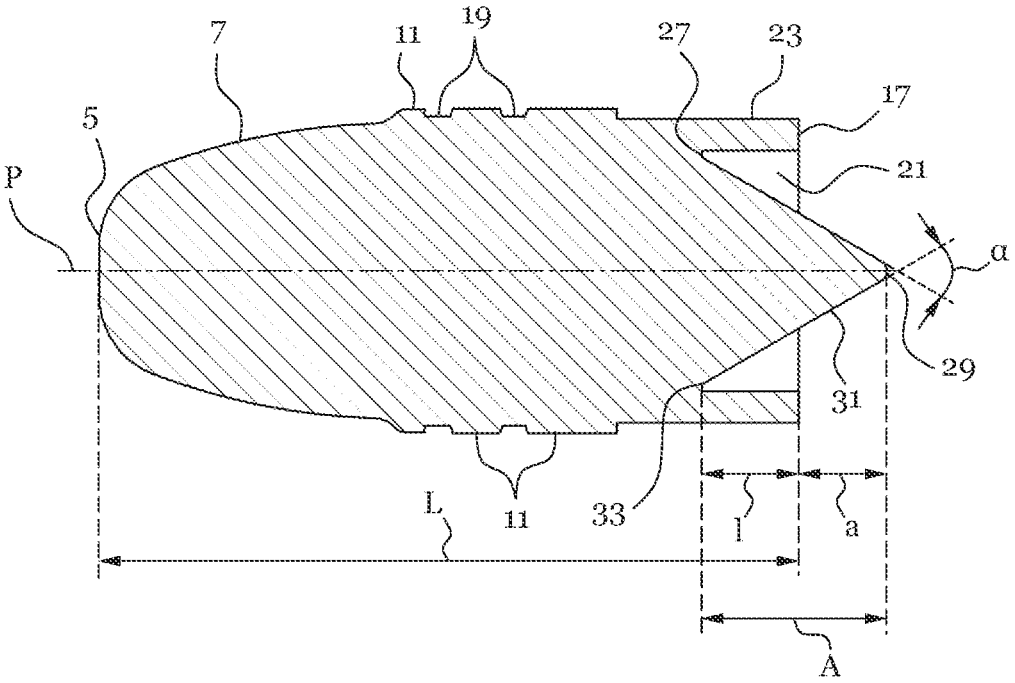
Figure 4:
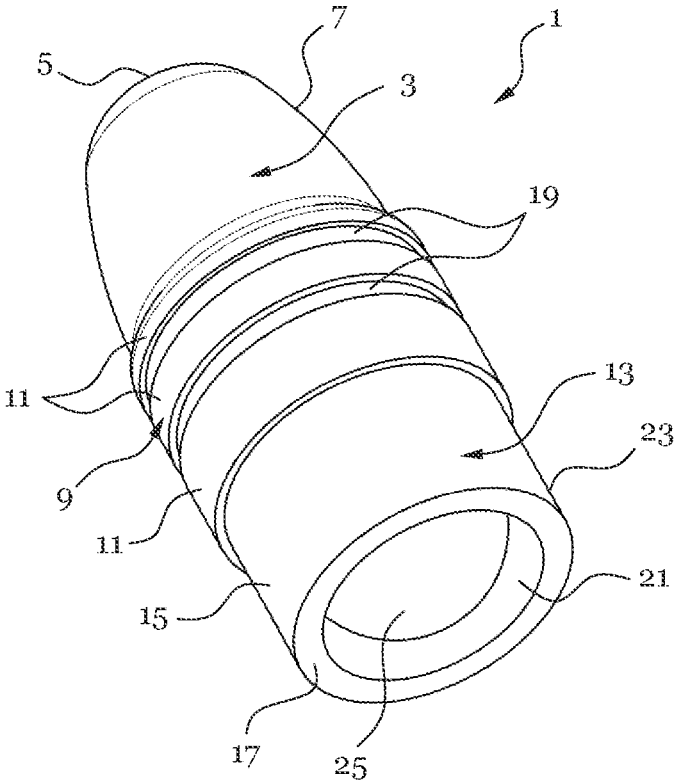
Figure 5:
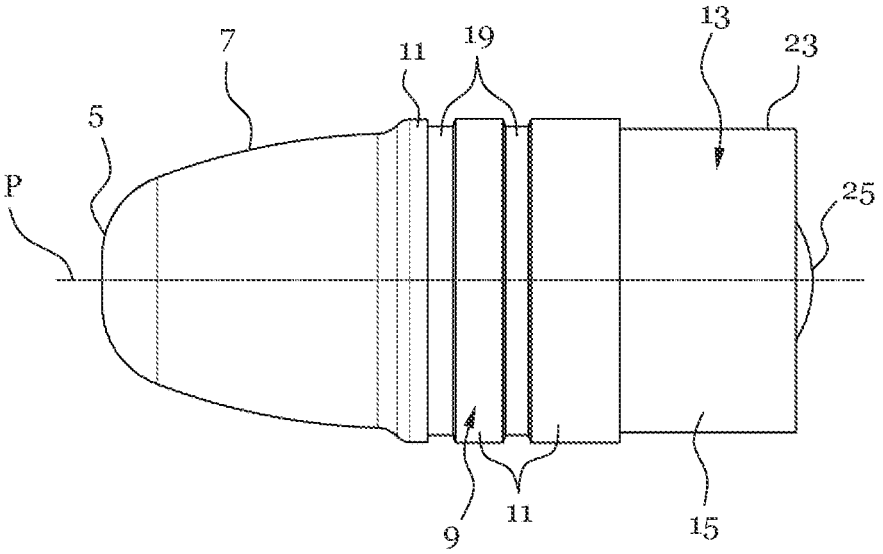

In the following, further features, characteristics and advantages of the invention are made clear by describing preferred embodiments of the invention on the basis of the enclosed exemplary drawings in which FIG. 1 shows a perspective view of a first exemplary embodiment of a projectile according to the invention;

FIG. 2 a side view of the projectile according to FIG. 1;

FIG. 3 a sectional view of the projectile as shown in FIGS. 1 and 2;

FIG. 4 a perspective view of a further exemplary embodiment of a projectile according to the invention;

FIG. 5 a side view of the projectile as shown in FIG. 4; and

Figure 6:
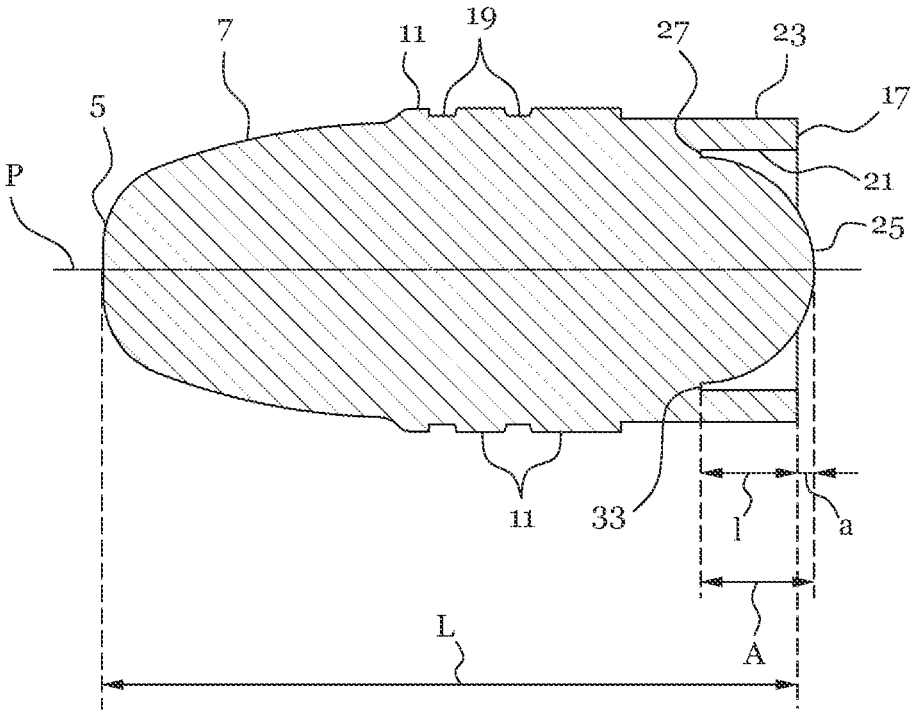

FIG. 6 a sectional view of the projectile of FIGS. 4 and 5.

In the following description of exemplary embodiments of inventive projectiles, an inventive projectile is generally assigned the reference number 1. Such projectiles 1 are used for ammunition, especially rimfire ammunition. According to the present invention, rimfire ammunition is ammunition where the ignition is realized via a rim section projecting radially from a jacket of a sleeve, in which the projectile 1 according to the invention is inserted, preferably pressed in, which is provided at a longitudinal end of the sleeve, preferably at a rear end, such as a tail-side end. In the radially protruding edge section, an ignition means is circumferentially provided, which is activated by a correspondingly cylindrically designed firing pin of a firearm, in particular of a hand firearm, in order to ignite the rimfire ammunition.

The projectile 1 according to the invention is manufactured, for example, by forming, in particular by tensile-compressive forming, preferably deep drawing, from a metal strip blank or metal wire blank. It is advantageous when the entire projectile 1 is manufactured from one piece.

The projectile 1 in accordance with the invention has a nose section 3 which, according to the exemplary embodiments, has an ogive shape with a jacket 7 which tapers or forms an ogive shape towards a projectile tip 5. A guide band 9 can be connected to the nose section 3, which generally takes over internal ballistic tasks of the projectile 1, in particular sealing a combustion chamber between the projectile 1 and the barrel, supporting the provision of rotation/twist about a longitudinal axis P extending in the longitudinal direction of the projectile and serving to guide the projectile in the barrel of the firearm. For example, the guide band 9 is divided into guide band sections 11 arranged at a distance from one another in the longitudinal direction of the projectile P, which may, for example, have the same radial dimension with respect to the longitudinal axis P of the projectile and/or different axial dimensions. Adjoining the guide band 9 is a projectile tail 13 with a substantially cylindrical outer jacket 15 and a flat end face 17 forming a projectile base. The projectile 1 is substantially cylindrical in shape when viewed from the outside, except for the ogive-shaped nose section 3, wherein in the area of the guide band 9 step-like shoulders are formed between the guide band sections 11 and intermediate annular grooves 19 (FIG. 2).

Furthermore, with reference to FIG. 1, it can be seen that the projectile tail 13 has an annular recess 21 which is open towards the end face 17. Furthermore, the projectile tail 13 comprises an annular rim 23, which delimits the annular recess in the circumferential direction with respect to the longitudinal axis P of the projectile and whose outer side is formed by the jacket 15. In addition, the projectile 1 comprises a tail-side projection 25 extending in the longitudinal direction of the projectile. In accordance with the invention, at least the annular edge 23 and the projection 25, optionally also the nose section 3, are manufactured from one piece, for example from a metal wire blank or metal strip blank, preferably by means of a forming process, in particular a tensile-compressive forming process, in particular by deep drawing.

With reference to FIGS. 1-3, a first exemplary embodiment of the projectile 1 according to the invention is described and with reference to FIGS. 4-6, a further exemplary embodiment of a projectile 1 according to the invention is described. The following description mainly discusses the differences between FIGS. 1-3 and 4-6, which are primarily relate to the dimensions and shape of the projection 25.

In FIGS. 1-3, the projection 25 is conical in shape and has a cross-section which tapers continuously from a recess ground 27 (FIG. 3) towards the projectile tail 13, ending in a cone tip 29. In particular, FIG. 2 shows that the projection 25 is concentrically arranged with regard to the longitudinal axis P of the projectile oriented in the longitudinal direction of the projectile. In the exemplary embodiment according to FIGS. 1-3, the projection 25 is dimensioned in such a way that an axial length A is in the range of 20%-140%, preferably about 50%, of a calibre diameter. Furthermore, the projection 25 axially protrudes the end face 17 in the longitudinal direction of the projectile (reference mark a), in particular by at least 5% and/or at most 50% of a calibre diameter, in particular by about 20%. An aperture angle $\alpha$, indicated in FIG. 3, of a shell 31 of the projection 25 starting from the cone tip 29 is in the range of at least 20% and preferably at most 90%, preferably about 60%.

As can be seen in particular in FIG. 3, the annular edge 23 has a substantially constant wall thickness which is, for example, in the range of 5%-30%, preferably in the range of 8% to preferably 20%, of the calibre diameter. Furthermore, an axial dimension 1 of the annular edge 23 can be in the range of 5%-30% of a total length L of the projectile 1. It is advantageous, as shown in the exemplary figures, when the annular edge 23 is concentrically arranged with regard to the projectile axis P and has a constant outer diameter. In particular, this results in a completely axially symmetrical projectile 1 with respect to the longitudinal axis P of the projectile.

Referring again to FIG. 3, it can be seen that the annular recess 21 radially outwardly surrounds the projection 25 in the circumferential direction. In cross section, as shown in FIG. 3, the annular recess 21 is essentially triangular in shape. The annular recess 21, starting from a transition contour 33, can continuously expand between the projection 25 and the annular edge 23, so that a cross-section of the annular recess 21 continuously increases, i.e. continuously increases in the direction of the open end face 17. For example, the transition contour 37 is a transition edge without relevant radial dimensioning. This is realized by the fact that the projection 25 preferably circumferentially merges directly into the annular edge 23. Furthermore, the transition contour 33 can be provided with a relevant radial dimensioning, which is, for example, in the range of more than 0.05 mm to preferably 1.5 mm. This can be realized in that the projection 25 in the projectile interior merges into the recess ground 27 in such a way that the recess ground 27 is oriented in the radial direction and the recess ground 27 merges into the annular edge 23. The ring dimension of the recess ground determines the dimension of the transition contour 33.

With reference to FIGS. 4-6, a further exemplary embodiment of a projectile 1 according to the invention is described, which essentially differs from the design according to FIGS. 1-3 in that the projection 25 is curved in the direction of the end face 17. For example, the projection 25 has a partial spherical shape, in particular a hemispherical shape. In particular, due to its curvature, the hemispherical projection 25 protrudes axially in the longitudinal direction of the projectile axially beyond the end face 17 of the projectile tail 13 less than the conical projection 25 in FIGS. 1-3. An axial protrusion a of the hemispherical projection 25, as indicated in FIG. 6, is therefore significantly smaller than the axial projection a of the conical projection 25, as shown in FIG. 3. Due to the geometry of the hemispherical projection 25, the geometry of the annular recess 21 also changes. While the annular recess, as shown in FIG. 3, has an essentially triangular shape with straight triangular flanks, the annular recess 21 according to the embodiment of FIGS. 4-6, as shown in particular in FIG. 6, may also have an essentially triangular shape but the hypotenuse is curved according to the curvature of the hemispherical projection shape. Thus, with the same axial length of the annular edge 23, the annular recess 21, especially its volume, is smaller than that shown in FIGS. 1-3.

The features disclosed in the above description, figures and claims may be relevant to the realisation of the invention in the various embodiments, either individually or in any combination.

REFERENCE SIGN LIST

1 projectile
3 nose section

5 project tip
7 ogive-shaped jacket
9 driving band
11 driving band section
13 projectile tail
15 jacket
17 end face
19 annular groove
21 annular recess
23 annular edge
25 projection
27 recess ground
29 tip
31 projection shell
33 transition contour
L projectile length
l axial length of the annular action
A axial length of the protection
a protrusion of the projection
α opening angle

The invention claimed is:

1. A projectile for ammunition, comprising a nose section and a projectile tail, an end face of the projectile tail having an annular recess, an annular edge circumferentially surrounding the annular recess and radially outwardly delimiting the recess in the circumferential direction, and a projection arranged in the annular recess and extending in the longitudinal direction of the projectile, wherein the annular edge and the projection are manufactured in one piece.

2. The projectile according to claim 1, wherein the annular edge comprises an essentially constant wall thickness of 5% to 30% of a caliber diameter and/or an axial dimension of the annular edge is in the range between 5% to 30% of a total length of the projectile and/or the annular edge is arranged concentrically with regard to the projectile length axis oriented in the longitudinal direction of the projectile and/or the annular edge comprises a constant outer diameter.

3. The projectile according to claim 1 wherein the projection comprises a cross-section that at least in sections continuously tapers, wherein the projection is conically, frustoconically, or partly spherically formed, and wherein the projection is arranged concentrically with regard to the projectile length axis oriented in the longitudinal direction of the projectile.

4. The projectile according to claim 1, wherein the annular recess radially outwardly surrounds the projection in the circumferential direction and the projection circumferentially merges directly into the ring edge.

5. The projectile according to claim 1, wherein the annular recess, starting from a transition contour between the projection and the annular edge at least in sections continuously expands, and wherein a cross-section of the annular recess at least in sections continuously increases.

6. The projectile according to claim 1, wherein the projection comprises an axial length in the area of 20% to 140% of a caliber diameter and/or protrudes the end face of the projectile tail in the longitudinal direction of the projectile for at least 5% of a caliber diameter and/or for at most 50% of a caliber diameter.

7. The projectile according to claim 1, wherein the projection comprises a conical shape or a frustum shape and an aperture angle of the projection, starting from a cone tip or an end of a truncated cone, is at least 20° and at most 90°.

8. The projectile according to claim 1, wherein the projection in a projectile interior merges into an annular recess ground portion oriented in the radial direction, wherein the annular recess ground portion merges into the annular edge and has a radial annular dimension of at least 0.05 mm and at most 1.5 mm.

9. The projectile according to claim 1, which is manufactured by a tensile compressive forming.

10. A method for manufacturing the projectile according to claim 1, where a metal strip blank or metal wire blank is provided, the metal strip blank or metal wire blank is formed for the formation of the nose section and the projectile tail, and the annular recess as well as the projection extending in the longitudinal direction of the projectile are formed in the projectile tail.

11. Ammunition, comprising an ammunition sleeve and the projectile according to claim 1 pressed into the ammunition sleeve.

12. Ammunition according to claim 11, wherein the nose section protrudes the ammunition sleeve in the longitudinal direction of the projectile and/or wherein a driving band connecting the nose section with the projectile tail end or the projectile tail is pressed with an inner shell of the ammunition sleeve.

13. The projectile according to claim 1, wherein the nose section has an ogive-shape.

14. The projectile according to claim 1, wherein the annular edge, the projection and the nose section are manufactured in one piece.

15. The projectile according to claim 1, wherein the annular edge comprises an essentially constant wall thickness of 5% to 30% of a caliber diameter, an axial dimension of the annular edge is in the range between 5% to 30% of a total length of the projectile, the annular edge is arranged concentrically with regard to the projectile length axis oriented in the longitudinal direction of the projectile, the annular edge comprises a constant outer diameter.

16. The projectile according to claim 3, wherein the projection is conically or frustoconically formed.

17. The projectile according to claim 3, wherein the projection is partly spherically formed.

* * * * *